US007461701B2

(12) United States Patent
Gross et al.

(10) Patent No.: US 7,461,701 B2
(45) **Date of Patent: *Dec. 9, 2008**

(54) AEROSOL FIRE-RETARDING DELIVERY DEVICE

(75) Inventors: Marc V Gross, Shorewood, MN (US); Lawrence T. Weinman, Austin, TX (US)

(73) Assignee: Fireaway LLC, Minnetonka, MN (US)

( * ) Notice: Subject to any disclaimer, the term of this patent is extended or adjusted under 35 U.S.C. 154(b) by 45 days.

This patent is subject to a terminal disclaimer.

(21) Appl. No.: 11/279,225

(22) Filed: Apr. 10, 2006

(65) Prior Publication Data

US 2007/0246229 A1 Oct. 25, 2007

(51) Int. Cl.

| | |
|---|---|
| ***A62C 13/22*** | (2006.01) |
| ***A62C 11/00*** | (2006.01) |
| ***A62C 37/12*** | (2006.01) |
| ***F42B 12/46*** | (2006.01) |

(52) U.S. Cl. ..... 169/30; 169/57; 169/84; 102/367; 102/370

(58) Field of Classification Search ..... 169/30, 169/57, 84, 26, 28, 36, 42, 46, 47, 51, 52, 169/56, 71; 102/367–370, 275.11
See application file for complete search history.

(56) References Cited

U.S. PATENT DOCUMENTS

| | | | | |
|---|---|---|---|---|
| 1,510,843 | A | 10/1924 | Hawkins | |
| 1,588,234 | A | 6/1926 | Kauch | |
| 1,774,952 | A | 9/1930 | Thiecke | |
| 1,878,491 | A | 9/1932 | Goss | |
| 2,838,122 | A * | 6/1958 | Hutchinson | 169/84 |
| 2,873,806 | A | 2/1959 | Bittner | |
| 3,380,383 | A | 4/1968 | Snenepfe, Jr. | |
| 3,613,794 | A | 10/1971 | Naumann et al. | |
| 3,724,381 | A | 4/1973 | Gawlick et al. | |
| 3,785,569 | A | 1/1974 | Helmrich | |
| 3,833,063 | A | 9/1974 | Williams | |
| 4,197,213 | A * | 4/1980 | Pietz et al. | 252/372 |
| 4,436,159 | A | 3/1984 | Revay | |
| 4,843,965 | A | 7/1989 | Merzals | |
| 5,423,384 | A * | 6/1995 | Galbraith et al. | 169/12 |

(Continued)

FOREIGN PATENT DOCUMENTS

| | | |
|---|---|---|
| EP | 1479414 A1 | 11/2004 |
| GB | 271363 | 5/1927 |
| GB | 2161379 | 1/1986 |
| GB | 2299020 | 9/1996 |
| WO | WO-2008057139 A2 | 5/2008 |

OTHER PUBLICATIONS

"Aero-K® Fire Suppression Systems", *Brochure, Sensor Electronics Corporation*, Minneapolis, MN, USA, (before Jan. 2006), 6 pgs.

(Continued)

*Primary Examiner*—Darren W Gorman
(74) *Attorney, Agent, or Firm*—Schwegman, Lundberg & Woessner, P.A.

(57) ABSTRACT

A fire retarding canister has a housing with aerosol exit ports. A cooling material is supported within the housing above the exit ports. A combustion chamber within the housing is above the cooling material. An aerosol forming composition is supported within the housing above the combustion chamber. An ignition mix extends into the aerosol forming composition for igniting the aerosol forming composition.

21 Claims, 3 Drawing Sheets

U.S. PATENT DOCUMENTS

| | | | | |
|---|---|---|---|---|
| 5,425,426 | A * | 6/1995 | Baratov et al. | 169/46 |
| 5,613,562 | A * | 3/1997 | Galbraith et al. | 169/12 |
| 5,660,236 | A | 8/1997 | Sears et al. | |
| 5,831,209 | A | 11/1998 | Kozyrev et al. | |
| 5,865,257 | A | 2/1999 | Kozyrev et al. | |
| 5,884,710 | A | 3/1999 | Barnes et al. | |
| 5,915,480 | A | 6/1999 | Yemelyanov et al. | |
| 5,927,082 | A | 7/1999 | Sidelnikov et al. | |
| 5,992,528 | A | 11/1999 | Parkinson et al. | |
| 6,024,889 | A | 2/2000 | Holland et al. | |
| 6,042,664 | A | 3/2000 | Kozyrev et al. | |
| 6,089,326 | A | 7/2000 | Drakin | |
| 6,116,348 | A | 9/2000 | Drakin | |
| 6,264,772 | B1 | 7/2001 | Drakin | |
| 6,622,801 | B1 | 9/2003 | Rondino | |
| 6,689,285 | B2 | 2/2004 | Rusin et al. | |
| 7,389,825 | B2 | 6/2008 | Gross | |
| 2003/0062175 | A1 * | 4/2003 | Olander et al. | 169/51 |
| 2004/0262017 | A1 | 12/2004 | Gaidano et al. | |
| 2007/0068683 | A1 | 3/2007 | Pavesi | |
| 2007/0163787 | A1 | 7/2007 | Posson et al. | |
| 2007/0235200 | A1 | 10/2007 | Gross | |
| 2007/0245918 | A1 | 10/2007 | Gross | |

OTHER PUBLICATIONS

"FP-1000M", *Technical Data Sheet, Celanova Limited Fire-Pro®*, (Nov. 27, 2003), 1 pg.

"U.S. Appl. No. 11/279,228 Non-Final Office Action mailed Nov. 16, 2007", OARN,8 pgs.

"U.S. Appl. No. 11/279,228 response filed Dec. 11, 2007 to Office Action mailed Nov. 16, 2007.", 11 pgs.

"U.S. Appl. No. 11/279,228 Non-Final Office Action mailed Jul. 2, 2007", 11 pgs.

"U.S. Appl. No. 11/279,228 Response to Non-Final Office Action filed Oct. 1, 2007", 17 pgs.

"Notice of Allowance Mailed Oct. 18, 2007 in U.S. Appl. No. 11/279,228", 4 pgs.

"A Revolution in Fire Suppression Technology", Pyrogen Corporation SDN BHD, Malaysia,(undated),6 pgs.

"U.S. Appl. No. 11/279,221 Non-Final Office Action mailed May 1, 2008", OARN, 11 pgs.

"U.S. Appl. No. 11/279,221, Response filed Jun. 5, 2008 to Non-Final Office Action mailed May 1, 2008", 16 pgs.

"U.S. Appl. No. 11/279,228, Notice of Allowance mailed Jan. 31, 2008", 7 pgs.

"Micro-K tm Aerosol Technology", (c) 1997 Ansul Incorporation,(1997),25 pgs.

"International Application Serial No. PCT/US2007/00831, Written Opinion mailed Jul. 8, 2008", 8 pgs.

"International Application Serial No. PCT/US2007/00831, Article 19 Amendment mailed Oct. 3, 2008", 7 pgs.

"International Application Serial No. PCT/US2007/00831, Search Report mailed Jul. 8, 2008", 4 pgs.

Fletcher, M., "Fighting Fire with Fire", *Eureka, Findlay Publications Ltd.*, vol. 20, No. 1, (Jan. 1, 2000), p. 17 only.

* cited by examiner

AEROSOL FIRE-RETARDING DELIVERY DEVICE

BACKGROUND

Fire extinguishing aerosol devices generally have a housing with a discharge opening, a charge for producing a fire-extinguishing aerosol, and an ignition unit. When the ignition unit is operated, the pyrotechnic or solid-fuel charge is ignited, and the gaseous combustion products thereof form the fire extinguishing aerosol that passes through the discharge opening into the fire region and extinguishes the fire. In some prior devices, the ignition unit comprises an igniter positioned on or in the pyrotechnic that ignites when electrically activated or heated to a high temperature, such as that caused by a fire. One problem in causing ignition in this manner is that the igniter must be inside the housing, thus requiring that the container itself reach a high temperature prior to ignition.

Another shortcoming is the necessity to connect electrically operated units to suitable detection devices and releasing panels (cost, maintenance, reliability issues.) In some prior devices, a fuse, such as one composed of cordite extends outside of the container. Such fuses, while igniting in response to a desired temperature, are prone to damage and potential malfunction (fuse is limited to one, high activation temperature—significant damage occurs prior to activation). It is also dangerous to ship fire extinguishing devices which can be undesirably activated during shipment.

In one existing device, a bulb is used to hold a spring loaded pin in place. At a prespecified temperature, the bulb breaks, releasing the pin which ignites the pyrotechnic.

SUMMARY

A fire retarding canister has a housing with aerosol exit ports. A cooling material is supported within the housing above the exit ports. A combustion chamber within the housing is above the cooling material. An aerosol forming composition is supported within the housing above the combustion chamber. An ignition mix extends into the aerosol forming composition for igniting the aerosol forming composition.

In one embodiment, a fire extinguishing assembly includes a thermal ignition unit and an aerosol generating unit. The ignition unit in one embodiment comprises a spring loaded piston that is held under spring tension by a formed eutectic, which deforms at a predetermined temperature. When such temperature is reached, the piston is released, and strikes a primer to ignite a desired pyrotechnic in the aerosol generating unit. In a further embodiment, the eutectic is held in place by a restraining clip, which when removed, also releases the spring loaded piston to ignite the pyrotechnic. In one embodiment, the piston strikes a primer, which ignites an ignition mix, which further ignites the pyrotechnic. The ignition mix may be formed of the same material as the pyrotechnic. The primer may be a simple pistol primer in one embodiment, or other means of igniting the ignition mix.

The ignition unit may be releasably engaged with a canister that contains the pyrotechnic. In one embodiment, it is formed with threads for mating with threads on the canister. The ignition unit and canister may ship in an unassembled state, and then be easily assembled at a desired location of use to form the fire extinguishing assembly. Many different size canisters may use the same ignition unit. The inclusion of a restraining clip allows actuation of the extinguishing assembly either mechanically, or in direct response to heat In one embodiment, the aerosol generating unit comprises a canister having a housing with aerosol exit ports. A cooling material is supported within the housing above the exit ports. A combustion chamber is provided within the housing above the cooling material. The aerosol forming composition is supported within the housing above the combustion chamber. An ignition mix extends into the aerosol forming composition for igniting the aerosol forming composition.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description is, therefore, not to be taken in a limited sense, and the scope of the present invention is defined by the appended claims.

Figure 1:
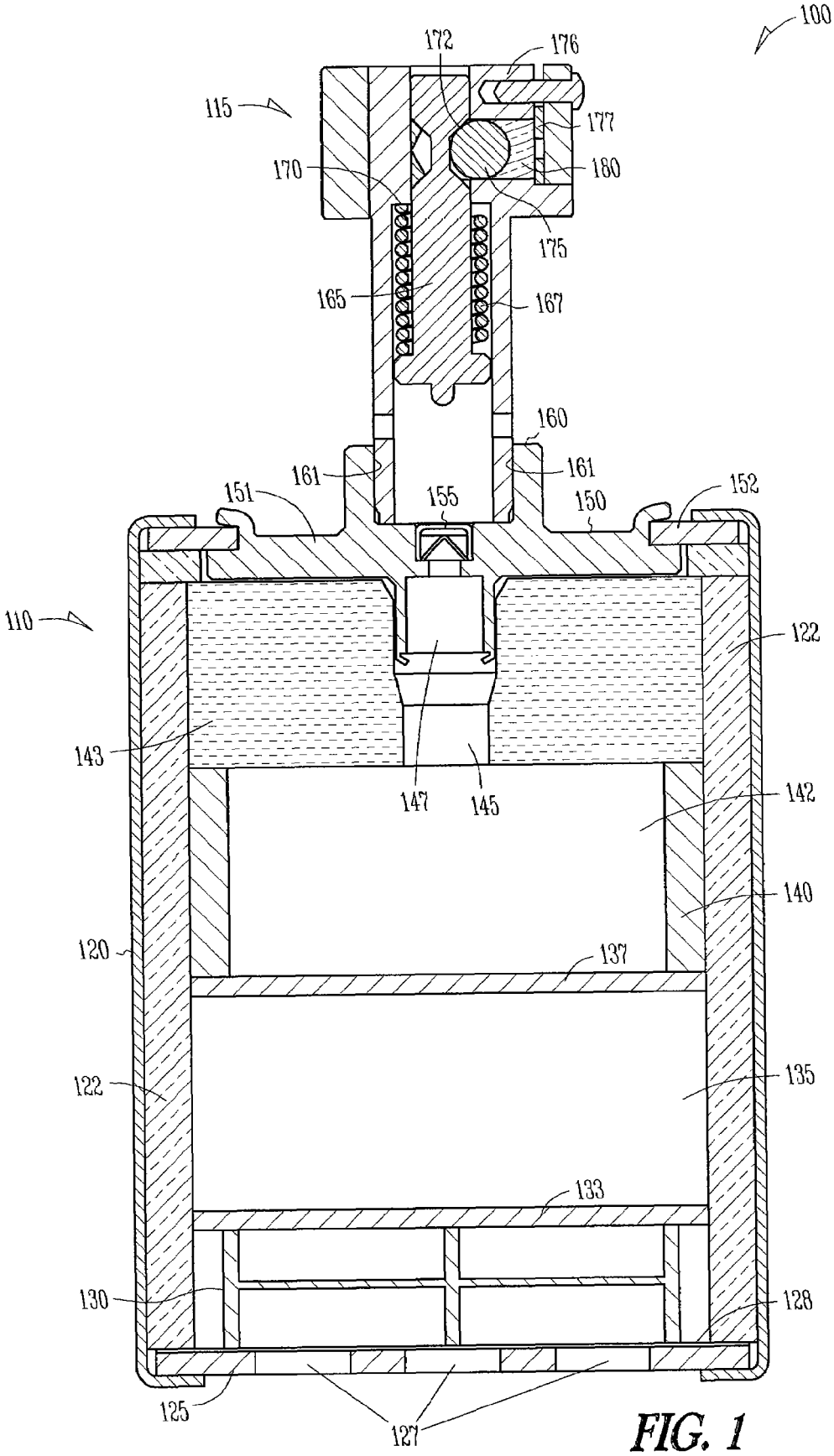
FIG. 1 is a cross section of an ignition unit mounted on an aerosol delivery canister according to an example embodiment.

FIG. 1 shows a cross section of a fire extinguishing assembly indicated generally at 100. The fire extinguishing assembly comprises a canister 110 for coupling with an ignition unit 115. The canister 110 includes a container 120 that may be lined with a desired material 122, such as ceramic paper, or insulative material such as cardboard. Ceramic paper may produce fewer toxic gases such as CO and unwanted odors as compared to other materials. Container 120 contains a bottom piece 125 with exit ports 127. A sealant 128, such as a poly sealant, may be used over the bottom piece 125 to provide an almost hermetic seal for contents inside container 120. A cross member spacer 130 formed of mild steel in one embodiment is positioned within the container 120 between the bottom piece 125. A first screen 133 is positioned adjacent the cross member spacer 130, and supports a cooling material 135, such as pieces of activated alumina, zeolite, marble chips, lava rock etc. In one embodiment, the pieces are approximately $\frac{1}{8}^{th}$ inch to ¼inch. Many other sizes and types of cooling material may also be used.

A second screen 137 is positioned on top of the cooling material 135, such that the first and second screens hold the cooling material 135 in position. The screens may be formed of stainless steel or other material compatible with the temperatures and other materials used in the canister. Spacer ring 140 formed of mild steel in one embodiment, is positioned on top of the second screen 137, and provides a combustion chamber 142. The spacer ring may be formed of other materials in further embodiments.

The spacer ring 140 also supports a pellet 143 comprising a pressed aerosol forming composition when ignited. The pellet 143 is formed with a hole or opening 145 that contains an ignition mix 147 that is supported within a bushing 150 fastened at a top end of the canister 120. In one embodiment, a cap 151 is sealed with the canister by means of an annular sealant or sealing ring 152. An ignition primer cap 155 is supported by the bushing 150 above the ignition mix 147 for igniting the ignition mix when struck. In a further embodiment, the pellet 143 may be formed without the ignition mix, and directly ignited by the primer cap.

The bushing 150 has an ignition unit receiving portion 160 that extends from the cap 151 and contains a threaded inner portion for receiving a threaded mating outer portion 161 of the ignition unit 115. The receiving portion 160 and mating portion 161 may couple to each other in other ways, such as friction or snap fit. Such coupling may be permanent or releasable in various embodiments.

The ignition unit 115, which in one embodiment is generally cylindrical in shape, has a firing pin 165 slideably mounted within it. The firing pin is coupled to a spring 167 that is compressed against a ledge 170 within the ignition assembly. The firing pin is formed with a detent, groove or annular depression 172 for receiving a restraining device, such as a ball bearing 175 held within a portion 176 of the ignition unit extending generally transverse to the firing pin. Detent 172 may be annular in one embodiment to allow ease of manufacture, removing the need to properly align the pin 165 prior to insertion of the ball bearing 175. In further embodiments, only a portion of the pin has the detent.

The groove 172 may have angled edges, allowing the ball bearing 175 or other stiff structure to move transversely away from the firing pin when no longer held against it. A restraining clip 177 fastened in the transverse extending portion of the ignition unit holds a formed eutectic 180, against the restraining device 175. The eutectic 180 is selected to deform at a desired temperature, releasing the restraining device 175, allowing the spring 167 to drive the firing pin into the ignition primer cap 155. The primer cap 155 will then fire, igniting the ignition mix 147 and in turn the pellet 143. Aerosol from the pellet 143 passes through the screens and cooling material 135, and cross member spacer 130, breaks open the sealant 128 and exits via exit ports 127. In one embodiment, the ignition temperature of the pellet is approximately 270 to 300° C., or other desired temperature which is a function of the chemical composition and method of preparation of the pellet.

In one embodiment, the bushing 150 is part of the ignition unit, and couples to the canister. The bushing 150 includes the primer and ignition mix, and may be shipped separately from the canister, and assembled when ready to use.

In one embodiment, the pellet 143 is formed of a composition comprising potassium nitrate (67-72), dicyandiamide (9-16), phenolformaldehyde resin (8-12), and potassium benzoate, bicarbonate or hexacyanoferrate (4-12) in various percentages by mass as indicated in parentheses. Various other compositions may be used, some of which are described in U.S. Pat. Nos. 6,042,664 and 6,264,772.

The size of the canister may be varied significantly to provide different amounts of aerosol producing material. In one embodiment, the mating threaded portions where the canister and ignition unit attach are the same size for the various sizes of canisters. Thus, a canister designed for inside a cabinet may be fairly small, such as smaller than a can of soda. Canisters designed for larger applications, such as retarding fires in a room, may be very large, All the canisters may use the same size ignition unit provided they are designed to attach to each other through the use of mating threaded portions, or other physical coupling mechanisms.

Figure 2:
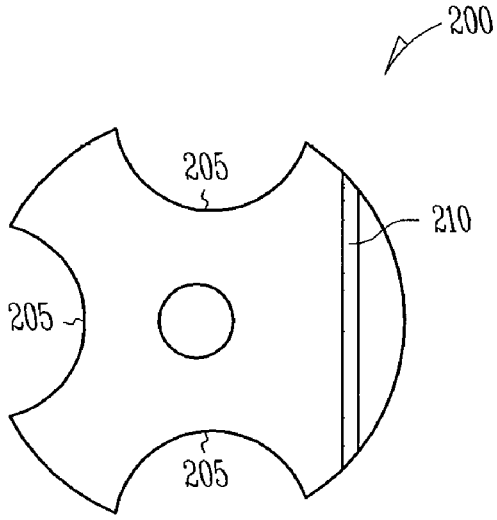
FIG. 2 is a top view of a firing pin for use in the ignition unit of FIG. 1 according to an example embodiment.

A top view of the ignition unit 115 is shown in FIG. 2 at 200. Several grooves may be cut into the top portion of the ignition unit as indicated at 205 to reduce the amount of material in the ignition unit 115, and thereby increase the responsiveness of the ignition unit to temperature changes. FIG. 2 also better illustrates a slot 210 for retaining clip 177.

Figure 3:
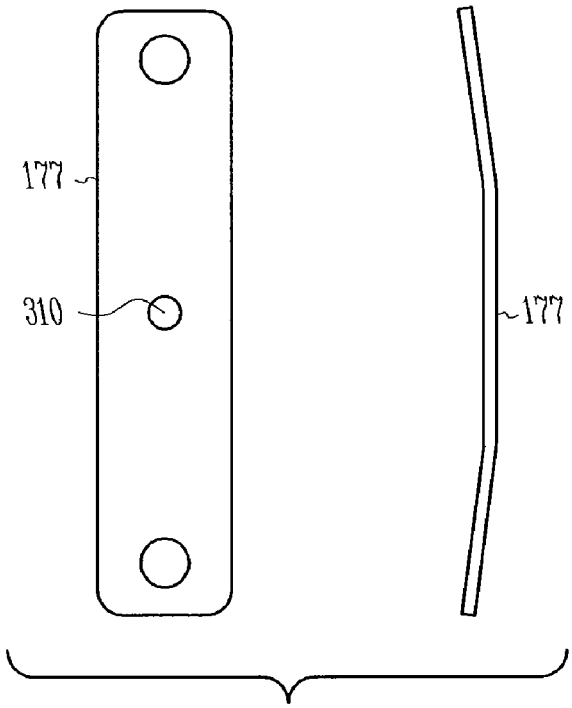
FIG. 3 is a top and side view of a retaining clip for retaining a formed eutectic according to an example embodiment.
Figure 4:
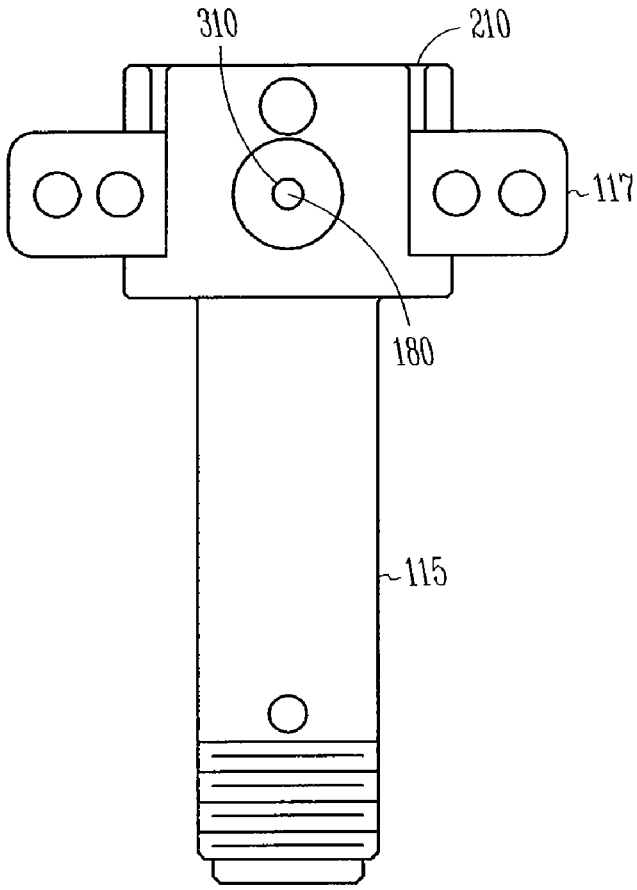
FIG. 4 is a side view of the firing pin of FIG. 2, and including the retaining clip of FIG. 3 for retaining a formed eutectic according to an example embodiment.
Figure 5A:
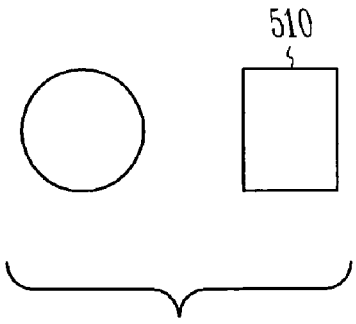
FIGS. 5A and 5B illustrate a eutectic pellet in raw form and after it has been formed for use in the firing pin of FIG. 2 according to an example embodiment.
Figure 5B:
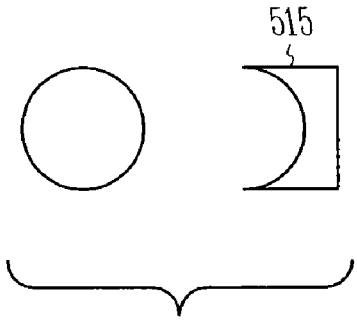

The slot is positioned to hold the retaining clip, shown in detail in FIG. 3 with side and top views, in a desired position as illustrated in a side view of the ignition unit with clip 177 installed in FIG. 4. FIG. 3 shows the retaining clip formed with a middle flat portion having a hole 310 formed therein. As seen in FIG. 4, hole 310 lines up with the formed eutectic 180, and provides a passage for the eutectic to flow though when heated, without allowing it to flow though when below the deformation temperature. Further holes may be formed in portions of the clip 177 as desired to allow attachment of cords or string for manual pulling of the clip 177. FIGS. 5A and 5B illustrate the eutectic prior to installation at 510 and shaped for installation at 515 respectively. Shaping of the eutectic may be done with a ball bearing under pressure. In one embodiment, suitable eutectic pellets 510 may be obtained from Cerro Metal Products Co., Bellefonte Works, P.O. Box 388, Bellefonte, Pa. 16823, or from other sources as desired. Available example melting temperatures include but are not limited to 158, 174, 198 and 203° F. In further embodiment, the eutectic deform at temperatures in the range of approximately 70° C. or lower, or much higher, such as 270 to 300° C., and just about anywhere between.

With the eutectic 180 formed or shaped as shown in FIG. 1, and a ball bearing 175 of substantially the same shape and diameter as the opening, the eutectic is prevented from further deforming at temperatures lower than its melting point, as there is no route available to it to deform into. The hole 310 in the clip is small enough to prevent significant flow, thus securing the pin in place until the eutectic 180 reaches a melting temperature. At that time, the eutectic flows through the hold in the clip, allowing the ball bearing to move away from the detent in the firing pin, and releasing the firing pin to ignite the pellet 143.

The Abstract is provided to comply with 37 C.F.R. §1.72(b) to allow the reader to quickly ascertain the nature and gist of the technical disclosure. The Abstract is submitted with the understanding that it will not be used to interpret or limit the scope or meaning of the claims.

The invention claimed is:

1. A fire retarding canister comprising:

a housing having aerosol exit ports;

a cooling material supported within the housing above the exit ports;

a combustion chamber within the housing above the cooling material;

an aerosol forming composition supported within the housing above the combustion chamber;

an ignition mix extending into the aerosol forming composition for igniting the aerosol forming composition; and a connector for connecting to an ignition unit comprising a temperature responsive firing pin, the connector coupled with the housing.

2. The fire retarding canister of claim 1 and further comprising a breakable sealer positioned over the exit ports.

3. The fire retarding canister of claim 1 wherein the aerosol forming composition is formed in the shape of a pellet having a hole through the proximate middle of the pellet.

4. The fire retarding canister of claim 3 wherein the ignition mix is located within the hole in the pellet.

5. The fire retarding canister of claim 4 wherein the ignition mix includes a primer cap which ignites the ignition mix in response to being struck by a firing pin.

6. The fire retarding canister of claim 1 wherein the connector comprises a threaded tube.

7. The fire retarding canister of claim 1 and further comprising an insulator disposed on an inside of the housing.

8. The fire retarding canister of claim 1 and further comprising a spacer ring disposed on an inside of the housing and separating the aerosol forming composition from the cooling material.

9. The fire retarding canister of claim 1 and further comprising a pair of screens on either side of the cooling material for holding the cooling material in place within the housing.

10. The fire retarding canister of claim 9 and further comprising a cross member spacer disposed in the housing between the cooling material and the exit ports.

11. The fire retarding canister of claim 1 wherein the cooling material comprises ⅛$^{th}$ inch to ¼ inch pieces of material selected from the group consisting of activated alumina, zeolite, marble chips and lava rock.

12. A fire retarding canister comprising:

a housing having aerosol exit ports;

a cooling material supported by opposed screens within the housing above the exit ports;

a spacer providing a combustion chamber within the housing above the cooling material;

a pellet shaped aerosol forming composition supported within the housing by the spacer above the combustion chamber;

an ignition mix extending into a hole through the aerosol forming composition for igniting the aerosol forming composition; and a connector for connecting to an ignition unit comprising a temperature responsive firing pin, the connector coupled with the housing.

13. The fire retarding canister of claim 12 and further comprising a breakable sealer positioned over the exit ports.

14. The fire retarding canister of claim 12 wherein the ignition mix includes a primer cap which ignites the ignition mix in response to being struck by a firing pin.

15. The fire retarding canister of claim 12 wherein the connector comprises a threaded tube.

16. The fire retarding canister of claim 12 and further comprising an insulator disposed on an inside of the housing.

17. The fire retarding canister of claim 12 and further comprising a cross member spacer disposed in the housing between the cooling material and the exit ports.

18. The fire retarding canister of claim 12 wherein the cooling material comprises ⅛$^{th}$ inch to ¼ inch pieces of material selected from the group consisting of activated alumina, zeolite, marble chips and lava rock or other materials with similar properties.

19. A method of creating a fire retarding aerosol in a canister, the method comprising:

striking a primer cap with a temperature responsive firing pin;

igniting an ignition mix disposed within an aerosol producing material to ignite the aerosol producing material to produce the aerosol;

providing a combustion chamber for the aerosol producing material;

cooling the aerosol by moving it through a cooling material opposite the combustion chamber; and exhausting the cooled aerosol through exit ports in the canister.

20. The method of creating the fire retarding aerosol in a canister of claim 19, wherein exhausting the cooled aerosol through exit ports includes rupturing a breakable sealer positioned over the exit ports with the exhausted cooled aerosol.

21. The method of creating the fire retarding aerosol in a canister of claim 19, wherein cooling the aerosol by moving it through the cooling material opposite the combustion chamber includes moving the aerosol through screens on either side of the cooling material.

* * * * *

UNITED STATES PATENT AND TRADEMARK OFFICE

CERTIFICATE OF CORRECTION

PATENT NO. : 7,461,701 B2
APPLICATION NO. : 11/279225
DATED : December 9, 2008
INVENTOR(S) : Gross et al.

It is certified that error appears in the above-identified patent and that said Letters Patent is hereby corrected as shown below:

In column 1, line 67, after “heat” insert -- . --.

In column 2, line 57, delete “1/4inch.” and insert -- ¼ inch. --, therefor.

In column 3, line 66, delete “large, All” and insert -- large. All --, therefor.

In column 4, line 15, delete “though” and insert -- through --, therefor.

In column 4, line 16, delete “though” and insert -- through --, therefor.

Signed and Sealed this

Twenty-fourth Day of February, 2009

JOHN DOLL
*Acting Director of the United States Patent and Trademark Office*